US007332043B2

(12) United States Patent
Tetyukhin et al.

(10) Patent No.: US 7,332,043 B2
(45) Date of Patent: Feb. 19, 2008

(54) TITANIUM-BASED ALLOY AND METHOD OF HEAT TREATMENT OF LARGE-SIZED SEMIFINISHED ITEMS OF THIS ALLOY

(75) Inventors: Vladislav Valentinovich Tetyukhin, Moscow (RU); Jury Ivanovich Zakharov, Moscow (RU); Igor Vasilievich Levin, Sverdlovskoy (RU)

(73) Assignee: Public Stock Company "VSMPO-AVISMA Corporation", Sverdlovsk Region (RU)

( * ) Notice: Subject to any disclaimer, the term of this patent is extended or adjusted under 35 U.S.C. 154(b) by 11 days.

(21) Appl. No.: 10/275,161

(22) PCT Filed: Feb. 5, 2001

(86) PCT No.: PCT/RU01/00044

§ 371 (c)(1),
(2), (4) Date: Oct. 31, 2002

(87) PCT Pub. No.: WO02/06543

PCT Pub. Date: Jan. 24, 2002

(65) Prior Publication Data

US 2003/0164212 A1 Sep. 4, 2003

(30) Foreign Application Priority Data

Jul. 19, 2000 (RU) ..... 2000119231

(51) Int. Cl.
*C22C 14/00* (2006.01)

(52) U.S. Cl. ..... 148/421; 420/420

(58) Field of Classification Search ..... 148/421; 420/420

See application file for complete search history.

(56) References Cited

U.S. PATENT DOCUMENTS

| | | | |
|---|---|---|---|
| 4,067,734 | A | 1/1978 | Curtis et al. |
| 4,889,170 | A | 12/1989 | Mae et al. |
| 5,332,545 | A | 7/1994 | Love |

FOREIGN PATENT DOCUMENTS

| | | | |
|---|---|---|---|
| RU | 2122040 | C1 | 11/1998 |
| SU | 443090 | * | 9/1974 |
| SU | 555161 | A | 5/1977 |
| SU | 912771 | A | 3/1982 |

* cited by examiner

*Primary Examiner*—Sikyin Ip
(74) *Attorney, Agent, or Firm*—David M. Ostfeld

(57) ABSTRACT

The inventive titanium alloy comprises, expressed in mass %: aluminium 4.0-6.3; vanadium 4.5-5.9; molybdenum 4.5-5.9; chromium 2.0-3.6; ferrum 0.2-0.5; the rest being titanium. An equivalent molybdenum content is determined as corresponding to $Mo_{equiv} \geqq 13.8$. The inventive method for heat treatment consists in heating to $t_{\beta \leftrightarrows \alpha+\beta}$−(30-70)° C., conditioning during 2-5 hrs, air or water cooling and age-hardening at a temperature ranging from 540° C. to 600° C. during 8-16 hrs. Said alloy has a high volumetric deformability and is used for manufacturing massive large-sized forged and pressed pieces having a high strength level, satisfactory characteristics of plasticity and fracture toughness.

1 Claim, No Drawings

TITANIUM-BASED ALLOY AND METHOD OF HEAT TREATMENT OF LARGE-SIZED SEMIFINISHED ITEMS OF THIS ALLOY

FIELD OF THE INVENTION

The inventions relates to non-ferrous metallurgy, and more particularly, to production of modern titanium alloys preferably used for manufacturing of large-sized forgings, stampings, massive plates, billets, fasteners and other parts for aeronautical engineering.

PRIOR STATE OF ART

Titanium-based alloy of the following composition, % by mass, is known:

| | |
|---|---|
| aluminum | 4.0-6.3 |
| vanadium | 4.5-5.9 |
| molybdenum | 4.5-5.9 |
| chromium | 2.0-3.6 |
| iron | 0.2-0.8 |
| zirconium | 0.01-0.08 |
| carbon | 0.01-0.25 |
| oxygen | 0.03-0.25 |
| titanium | the balance |

(RF Patent #2122040, C22C 14/00, 1998) as the prototype.

The said alloy possesses a good combination of high strength and plasticity of large-sized parts up to 150-200 mm thick, water or air hardened. The alloy is easily hot deformed and is welded by argon-arc and electron-bean welding.

The disadvantage of the alloy is an insufficient level of strength of massive large-sized parts more than 150-200 mm thick, air hardened.

The method of heat treatment of large-sized semifinished items made of two-phase titanium alloys comprising preheating up to the temperature 7-50° C. higher than the polymorphic transformation temperature, holding for 0.15-3 hours, cooling to the two-phase region temperature, 20-80° C. lower than the polymorphic transformation temperature, holding for 0.15-3 hours, hardening and aging is known (USSR Inventor's Certificate #912771. C22F, 1/18. 1982) as the prototype.

The disadvantage of the method is an insufficient level of strength of massive large-sized parts more than 150-200 mm thick.

DISCLOSURE OF THE INVENTION

An object of the claimed titanium-based alloy and method of heat treatment of large-sized semifinished items of the said alloy is to attain higher level of strength of massive large-sized parts 15-200 mm in excess thick.

The integral technical result attained in the process of realization of the claimed group of inventions is the regulation of optimal combination of β-stabilizing alloying elements in the produced semifinished item.

The said technical result is attained by the distribution of the components in the following relation, % by mass, in the titanium-based alloy containing aluminum, vanadium, molybdenum, chromium, iron and titanium:

| | |
|---|---|
| aluminum | 4.0-6.3 |
| vanadium | 4.5-5.9 |
| molybdenum | 4.5-5.9 |
| chromium | 2.0-3.6 |
| iron | 0.2-0.5 |
| titanium | the balance |

while the molybdenum equivalent $Mo_{3KB} \geqq 13.8$.

According to the invention the molybdenum equivalent is determined by the following relation:

$$Mo_{3KB} = \frac{\%\ Mo}{1} + \frac{\%\ V}{1.5} + \frac{\%\ Cr}{0.6} + \frac{\%\ Fe}{0.4} \quad (1)$$

The said technical result is attained also by the fact that in the method of heat treatment of large-sized semifinished items of the claimed titanium-based alloy comprising heating, holding at the heating temperature, cooling and aging, in accordance with the invention the heating is performed directly to $t_{\beta \leftrightarrows \alpha+\beta}$−(30-70)° C., holding at the said temperature is performed for 2-5 hours, and aging is performed at 540-600° C. for 8-16 hours. Cooling is performed in air or water.

Due to the regulation of β-stabilizers in the form of molybdenum equivalent according to relation (1) with establishing of its minimal value and optimization of processing to solid solution parameters, including heating and holding at the temperature lower than the polymorphic transformation temperature, massive articles of the claimed alloy after air (or water) hardening from the processing to solid solution temperature have more β-phase (the higher hardenability degree), thus ensuring after the aging step higher level of strength with satisfactory plasticity and destruction viscosity characteristics. This is of particular importance for massive large-sized forgings and stampings that require high level of strength, but quicker cooling of them (for instance, in water) from the processing temperature to solid solution is extremely undesirable because of inner stresses high level occurrence.

This application meets the requirement of unity of invention as the method of heat treatment is intended for manufacture of semifinished items of the claimed alloy.

EMBODIMENTS OF THE INVENTION

To study the alloy characteristics test 430 mm diameter ingots of the following average composition were manufactured:

TABLE 1

| Alloy | Chemical alloy | | | | | | | |
|---|---|---|---|---|---|---|---|---|
| $Mo_{3KB}$ | Al | Mo | V | Cr | Fe | Ti | β ↔ α + β | t° C. |
| 1 | 5.2 | 5.0 | 5.1 | 3.0 | 0.4 | the balance | 840 | 14.4 |
| 2 | 5.1 | 4.5 | 4.6 | 2.5 | 0.3 | the balance | 855 | 12.5 |

The ingots were forged in series in β, α+β, β, α+β-regions with finish deformation in α+β-region in the range of 45-50% per 250 mm diameter cylindrical billet.

Further the forgings were subjected to the following heat treatment:

a) Processing to solid solution: heating at 790° C., holding for 3 hours, air cooling.

b) Aging: heating at 560° C., holding for 8 hours, air cooling.

Mechanical properties of the forgings (averaged data in per unit direction) are given in table 2.

TABLE 2

| Alloy | $\sigma_{0.2}$(VTS), MPa (KSi) | $\sigma_B$(UTS), MPa(KSi) | δ(A) % | ψ(Ra), % | $K_{1C}$ MPa$\sqrt{M}$ (KSi$\sqrt{in}$) |
|---|---|---|---|---|---|
| 1 | 1213 (176) | 1304 (189) | 12 | 36 | 53.2 (48.4) |
| 2 | 1176 (170.5) | 1252 (181.5) | 15 | 40 | 57.3 (52.0) |

The test results show that the claimed alloy and the method of heat treatment permit to ensure higher level of strength characteristics of massive parts while maintaining satisfactory plasticity characteristics.

COMMERCIAL PRACTICABILITY

The claimed group of inventions is intended for production of massive large-sized parts and fasteners for aeronautical engineering.

The invention claimed is:

1. Titanium-based alloy for production of large sized parts and fasteners for aeronautical engineering, consisting of aluminum, vanadium, molybdenum, chromium, iron and titanium, wherein the content of the components is in the following ratio, percentage by mass:

| | |
|---|---|
| aluminum | 4.0-6.3 |
| vanadium | 4.5-5.9 |
| molybdenum | 4.5-5.9 |
| chromium | 2.0-3.6 |
| iron | 0.2-0.5 |
| titanium | balance, |

while the molybdenum equivalent $$Mo_{3KB} = \frac{\%Mo}{1} + \frac{\%V}{1.5} + \frac{\%Cr}{0.6} + \frac{\%Fe}{0.4} \geq 13.8.$$

* * * * *